Y2587 XR 3,993,975

United Stat TX 235/38

Long, Jr. et al.

[11] 3,993,975

[45] Nov. 23, 1976

[54] AUTOMATIC PARKING LOT GATE

[76] Inventors: Alvin W. Long, Jr., 10434 Rosedale Lane, Beltsville, Md. 20705; Marvin R. Blumberg, 7105 Broxburn Drive, Bethesda, Md. 20034; Sami E. Totah, 7504 Newburg Drive, Lanham, Md. 20801

[22] Filed: May 30, 1975

[21] Appl. No.: 582,390

[52] U.S. Cl. ..... 340/51; 49/25; 49/28; 235/61.8 A; 340/258 C

[51] Int. Cl.[2] ..... E05F 15/20; G08G 1/14

[58] Field of Search ..... 340/51, 38 R, 38 L; 235/61.8 A, 61.6 R; 49/35, 49, 25–28

[56] References Cited

UNITED STATES PATENTS

| | | | |
|---|---|---|---|
| 2,842,876 | 7/1958 | Chicoine et al. | 49/35 |
| 2,843,376 | 7/1958 | Osuch et al. | 49/26 X |
| 3,150,454 | 9/1964 | Staples | 49/49 X |
| 3,484,586 | 12/1969 | Wilson et al. | 340/51 |
| 3,626,637 | 12/1971 | Rudicel | 340/51 X |
| 3,641,314 | 2/1972 | Abramson | 340/51 X |
| 3,678,622 | 7/1972 | Miller | 49/28 |
| 3,719,005 | 3/1973 | Carli | 49/28 |
| 3,783,556 | 1/1974 | Cook | 49/25 |

*Primary Examiner*—Donald J. Yusko
*Attorney, Agent, or Firm*—Bacon & Thomas

[57] ABSTRACT

A parking lot gate control system having a pivoted normally horizontal gate bar which is automatically elevated to a raised non-obstructing position and then returned to its normal position by a mechanism driven by an electric motor under the control of a circuit including a clearance device at the entrance to the parking lot consisting of a switch unit operated by an identification card or coin and a car presence-sensing loop in the roadway beyond the clearance device. The circuit operates to raise the gate bar after a proper card or coin has been inserted in the clearance device; thereafter, the vehicle moves onto the loop. The gate bar descends after the vehicle leaves the loop. If another card or coin is inserted in the clearance device by the operator of a second car while the gate bar is descending, the gate bar reverses its downward movement and stays up until the second car has left the loop. If a vehicle obstructs the gate bar on its way down, the motor automatically reverses and returns the gate bar to upright position, and descends only after the vehicle has left the loop. If the entering vehicles are closely following each other, cancellation of the gate bar return signal takes place continuously until the last car leaves the loop.

17 Claims, 9 Drawing Figures

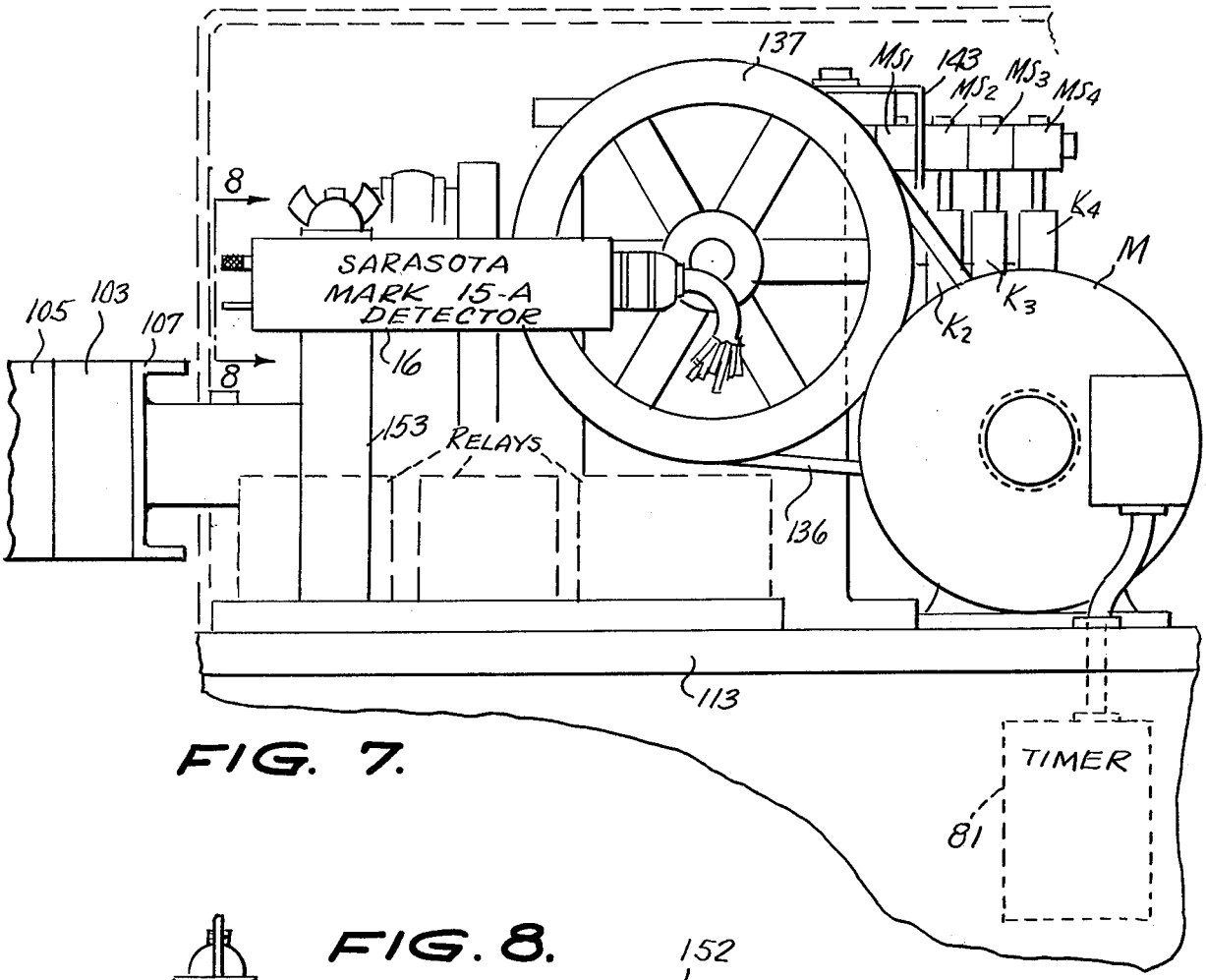
FIG. 7.
FIG. 8.
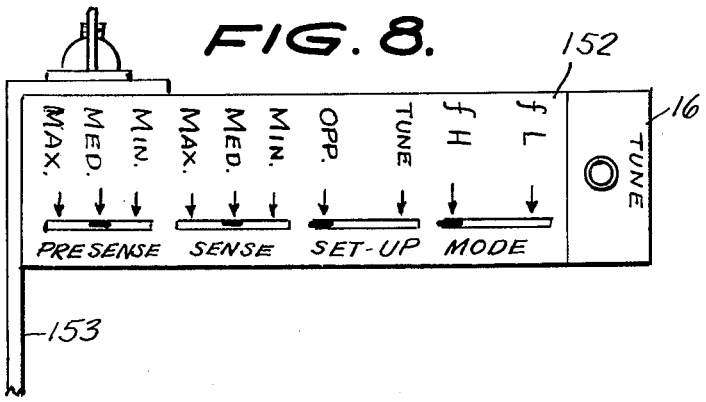

AUTOMATIC PARKING LOT GATE

This invention relates to parking lot gate control systems, and more particularly to an automatic parking lot pivoted gate-operating system which responds to the insertion of an identification card, coin, or similar object into an identification signal relay device, thereby causing the pivoted gate to open.

A main object of the invention is to provide a novel and improved parking lot gate control system which is automatic in operation and which does not require an attendant to supervise same.

A further object of the invention is to provide an improved parking lot gate control system of the type having a normally horizontal pivoted gate bar which is automatically elevated to a non-obstructing position responsive to the insertion of an identification card, coin, or similar object into a cooperating signal relay device, and which is automatically returned to its normal position when the vehicle has passed into the parking lot, the system involving relatively simple components, being reliable in operation, and automatically dealing with various different conditions which may arise as vehicles enter the associated parking lot.

A still further object of the invention is to provide an improved automatic parking lot gate control system of the type having a pivoted gate driven by an electric motor to raise and lower the gate, the electric motor being energized responsive to the insertion of a suitable identification card, coin or similar object into an identification signal relay device located at the entrance to the associated parking lot, the motor being operated to raise the gate bar responsive to the insertion of the identification object, and after a vehicles moves into the parking lot, to lower the gate bar toward its normal position, the system operating to cause the gate bar to reverse its action if a second vehicle actuates the identification signal relay and then attempts to enter the parking lot.

A still further object of the invention is to provide an improved parking lot gate control system of the type having a motor-operated gate bar wherein the gate bar will reverse its descent and return to its upright position if it should encounter an obstruction, such as a vehicle therebeneath while the arm is descending, whereby to prevent damage to the vehicle or to the gate bar operating mechanism.

A still further object of the invention is to provide an improved parking lot gate control system of the type employing an identification device responding to the insertion of an identification card, coin or the like, to actuate the system, and further having a vehicle-sensing loop which operates to return the parking lot gate bar toward its normal closed position after a vehicle has entered the parking lot, the system being provided with sections responding to various different contingencies which may arise during the operation of the associated circuit as a result of heavy traffic attempting to enter the parking lot, or other unusual conditions.

A still further object of the invention, is generally to provide an automatic parking lot gate control system which involves inexpensive parts, which is stable in operation, which does not require the presence of an attendant to supervise same, and which is economical as well as safe in operation.

Further objects and advantages of the invention will become apparent from the following description and claims, and from the accompanying drawings, wherein:

FIG. 7 is a somewhat enlarged transverse vertical cross-sectional view taken substantially on the line 7—7 of FIG. 3.

FIG. 8 is a fragmentary elevational view showing the adjusting panel of the pulse-generating detector circuit employed in the parking lot control system of FIGS. 1 to 7, said view being taken substantially on the line 8—8 of FIG. 7.

Figure 1:
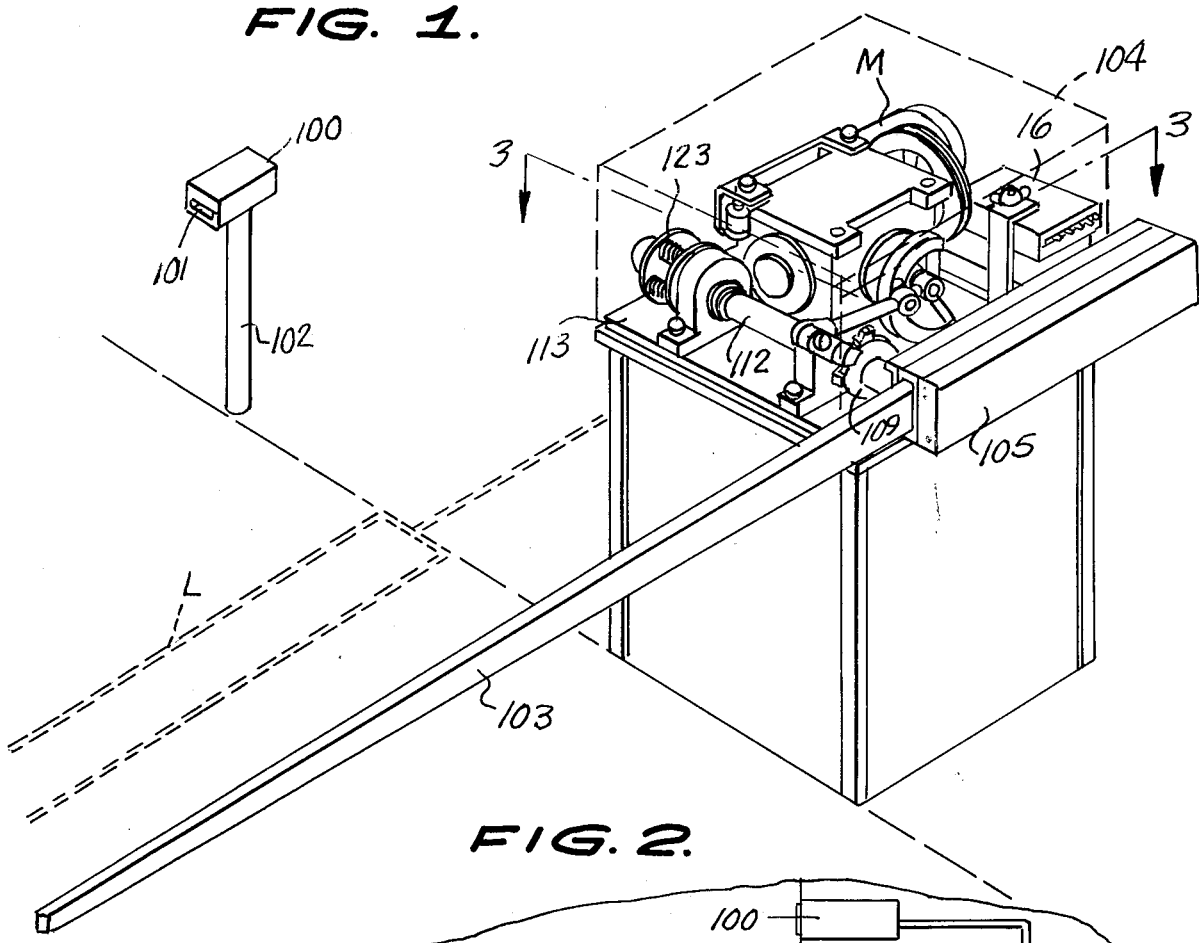
FIG. 1 is a perspective view showing the entrance portion of a parking lot equipped with a typical automatic gate control system according to the present invention.
Figure 2:
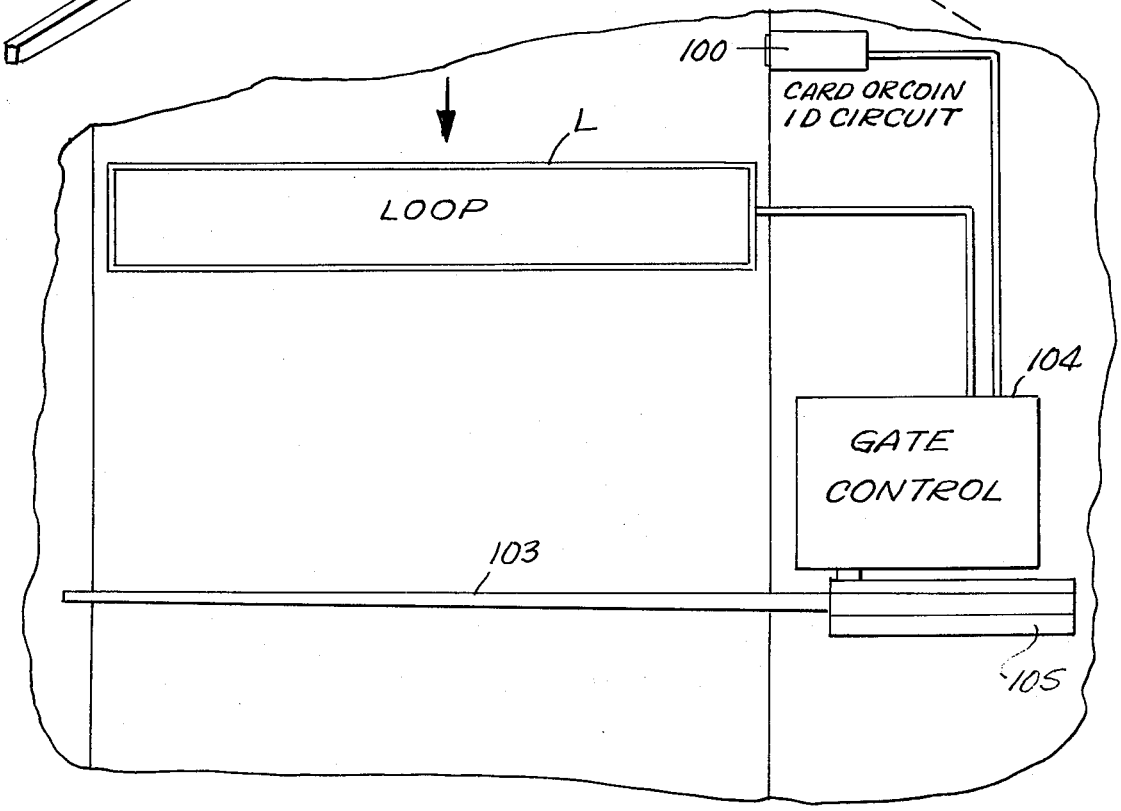
FIG. 2 is a diagrammatic top plan view of the parking lot entrance area shown in FIG. 1.

Referring to the drawings, FIGS. 1 and 2 illustrate the general layout of the elements at the entrance to a parking lot according to the present invention. Designated at 100 is a conventional clearance device which may comprise a unit adapted to receive an identification card of any suitable type to establish the user's identity, and if the proper card is inserted in the slot 101 of the device 100, a signal will be generated by the device 100 which is delivered to an identification signal relay 19 to operate same and close its contacts 18 (see FIG. 9). As will be readily apparent, the device 100 may be any suitable conventional identification clearance device or alternatively may be a coin-operated device of conventional construction operating in the same manner to provide a signal which is furnished to the relay 19 to close its contacts 18.

As shown in FIG. 1, the device 100 is preferably supported on a post 102 of sufficient height so that the operator of a vehicle can insert his card or coin in the device 100 without leaving the car.

Embedded in the roadway forwardly of the device 100 is a vehicle-sensing loop L which is employed to operate a conventional detector unit 16 (see FIG. 9) to generate a pulse in one of its output conductors and a steady voltage signal in another of its output conductors, as will be presently described. The loop L is located so that it will operate the detector unit 16 as the vehicle proceeds into the parking lot after a gate bar 103 has been elevated responsive to the operation of the identification signal relay device 19 in a manner presently to be described. The detector unit 6 is a commercial device and may comprise Sarasota mark 15-A, manufactured by Sarasota Engineering Company, Inc., 3135 North Washington Boulevard, Sarasota, Florida 33500. A device similar to this unit is shown in U.S. Pat. No. 3,683,351.

The gate bar 103 is rotatably mounted in a gate control unit, designated generally at 104, the gate bar 103 is being provided with a counterweight assembly 105 to facilitate its upward movement. The gate control unit 104 is suitably supported in a position sufficiently elevated so that the gate bar 103 presents a barrier to an approaching vehicle, namely, provides a horizontal barrier to a vehicle in a position to enter the parking lot, and, as will be presently described, the barrier is moved to an unobstructing position by the operation of the clearance device 100, as above mentioned.

Figure 3:
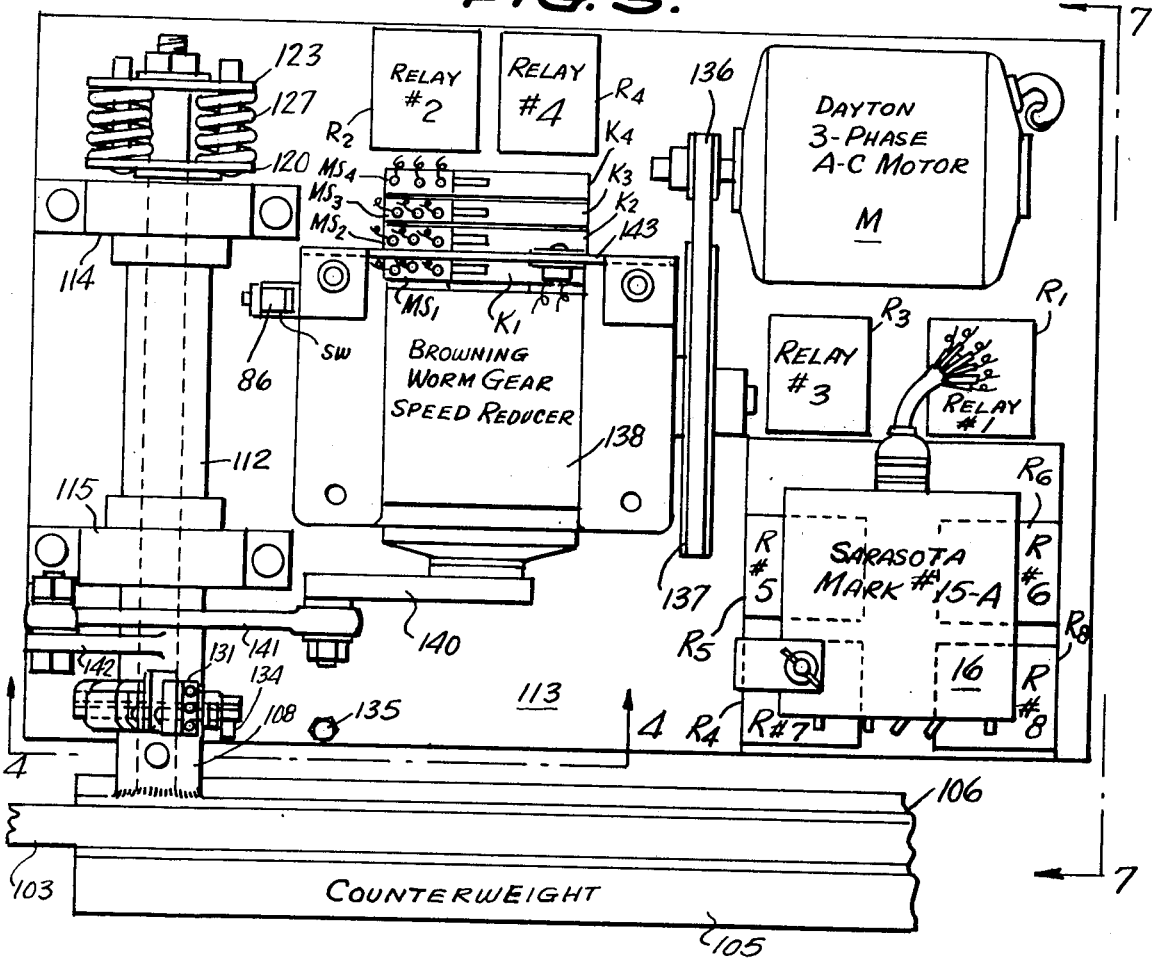
FIG. 3 is an enlarged horizontal cross-sectional view taken substantially on the line 3—3 of FIG. 1.
Figure 4:
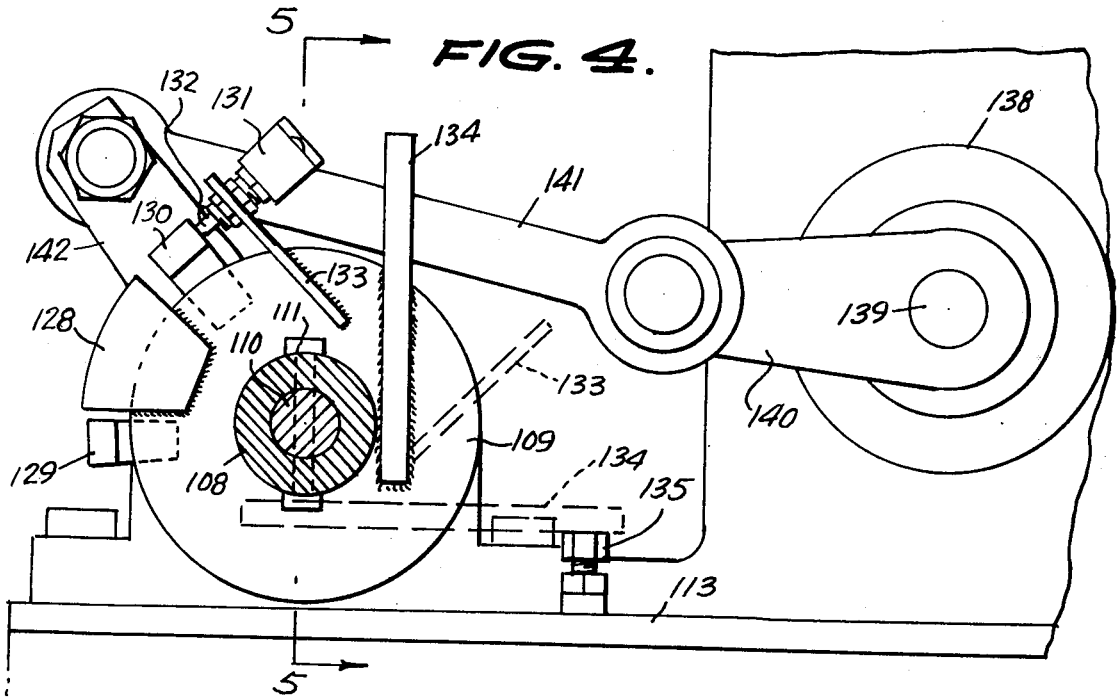
FIG. 4 is a somewhat enlarged fragmentary vertical cross-sectional view taken substantially on the line 4—4 of FIG. 3.
Figure 5:
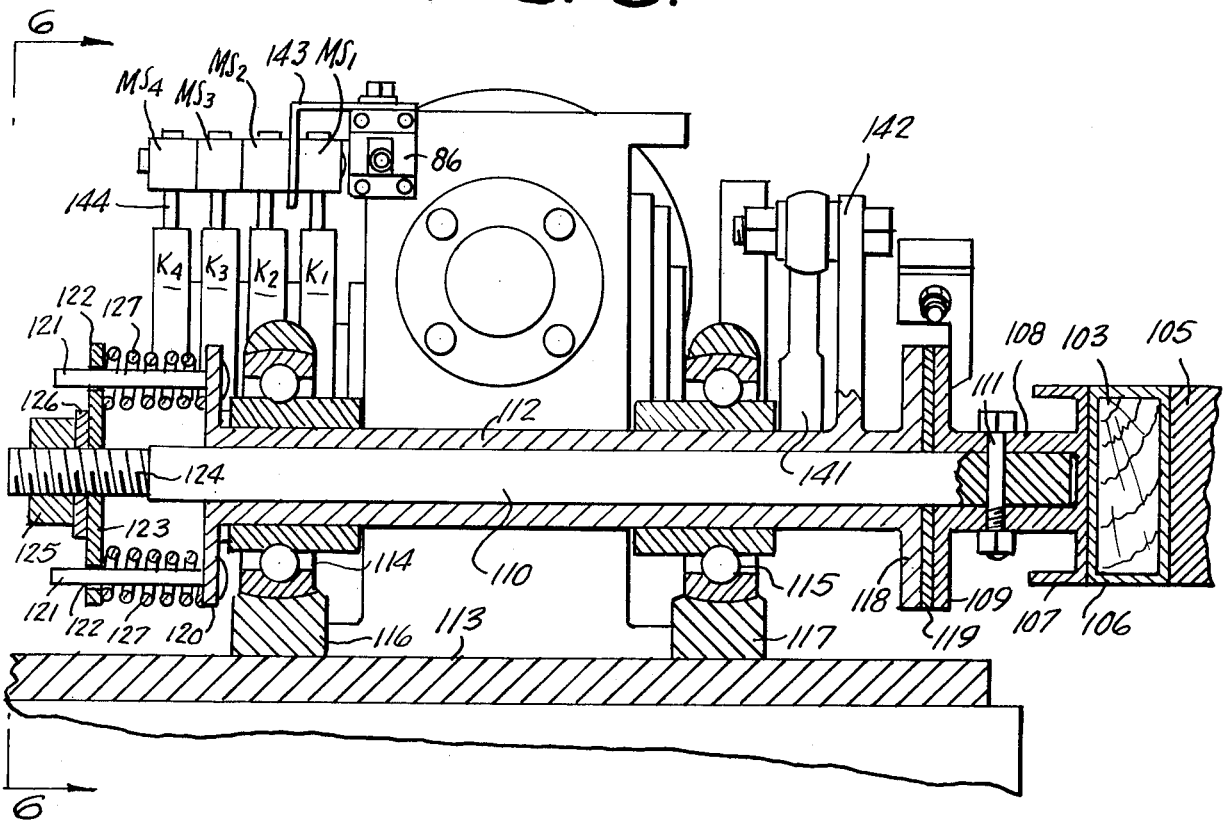
FIG. 5 is a fragmentary transverse vertical cross-sectional view taken substantially on the line 5—5 of FIG. 4.
Figure 6:
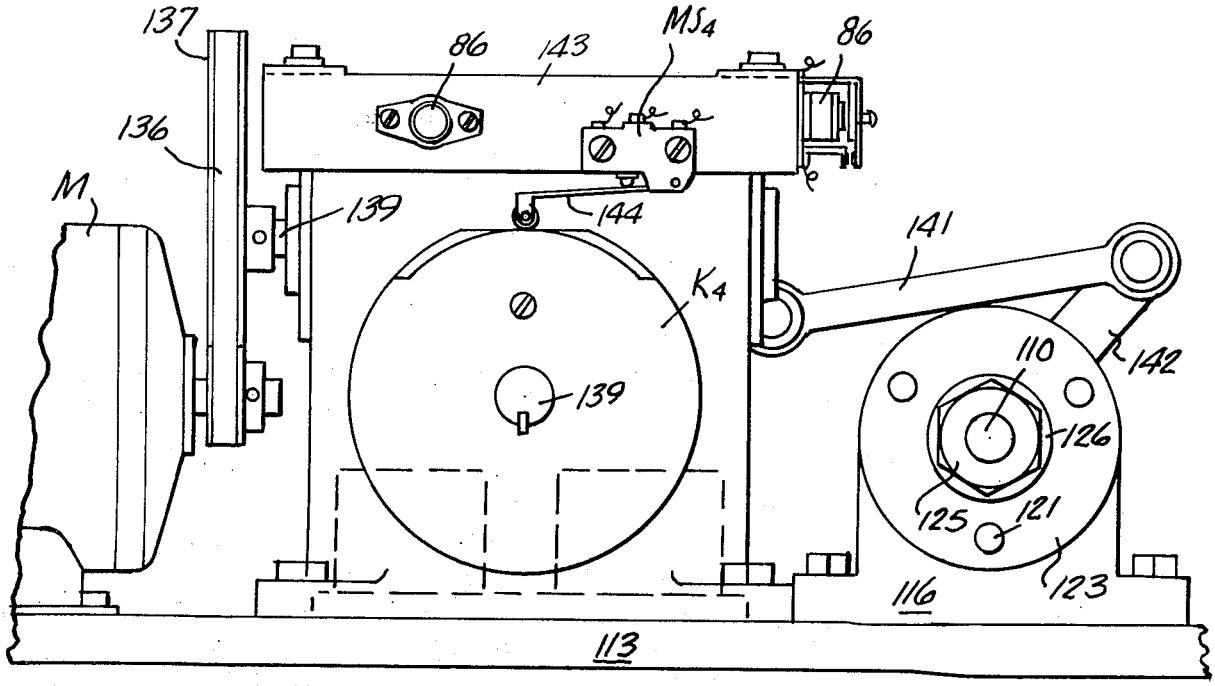
FIG. 6 is a fragmentary end elevational view taken substantially on the line 6—6 of FIG. 5.

As shown in FIGS. 3, 4 and 5, the gate bar 103 is secured in a rectangular sleeve 106 to the outer side of which the counterweight 105 is suitably fastened, the inner side of the sleeve 106 being rigidly secured to a channel bar 107 which has an integral horizontally extending sleeve portion 108 integrally formed with a clutch disc element 109. A horizontally extending shaft bolt member 110 is rigidly secured in the sleeve 108 by a transverse bolt 111, the shaft bolt 110 being rotatably received in a horizontal sleeve member 112 which is in turn journalled on the horizontal base plate 113 of the gate control assembly by means of a pair of spaced bearing assemblies shown at 114 and 115 in FIG. 5. The bearing assemblies 114 and 115 are mounted on respective upstanding block members 116 and 117 secured on the base plate 113.

The right end of sleeve member 112, as viewed in FIG. 5, is formed with a clutch disc element 118. Disc element 118 is separated from the gate bar disc element 109 by intervening frictional material 119 providing a yieldable coupling between the disc elements 118 and 109 as will be presently described. The left end of sleeve member 112, as viewed in FIG. 5, is formed integrally with a disc element 120 to which are rigidly secured a plurality of horizontal bolt members 121 which are angularly evenly spaced around the axis of sleeve member 112 and which extend through apertures 122 provided in a disc member 123 rotatably surrounding the threaded end 124 of shaft member 110 and retained thereon by a nut 125 and a washer 126, as shown in FIG. 5, the disc member 123 being biased against the washer 126 by a plurality of relatively heavy coil springs 127 surrounding the pin members 121 and bearing between disc 123 and flange disc 120. As will be apparent from FIG. 5, the springs 127 exert a biasing action on the sleeve 112 which is transmitted to the clutch disc 118, forcing the disc 118 toward the gate bar disc 109 and establishing a frictional coupling between the gate bar sleeve 108 and the horizontally mounted rotatable sleeve 112.

As shown in FIG. 4, a stop lug 128 is rigidly secured on the peripheral portion of clutch disc member 109 and extends between a pair of limit stop lugs 129 and 130 formed to be engaged by the intervening lug 128 to thereby limit the amount of relative rotation between the clutch disc members 109 and 118. An arm 133 is rigidly secured to the disc member 109 and carries a microswitch 131 having an operating plunger 132 which normally engages the lug 130, holding the microswitch open. As will be subsequently explained, when the downward movement of the gate bar 103 is blocked by an obstacle, such as a vehicle therebeneath, the lug 130 moves away from the microswitch plunger 132, releasing same and allowing the microswitch to close, to thereby automatically cause the gate arm to reverse its movement and move upwardly, as will be presently explained.

Rigidly secured to the disc member 109 is a stop arm 134 which is engageable with an adjustable stop screw 135 mounted on plate 113 to limit the rotation of the disc member 109 to that corresponding to the upright position of gate bar 103. When arm 134 reaches this position, as shown in dotted view in FIG. 4, it also causes the lug 130 to reengage the microswitch plunger 132 in the above-described automatic reversal action of the gate bar and to thereby open the microswitch 131. As above mentioned, microswitch 131 will be normally maintained open by the engagement of lug 130 with the plunger 132. The coasting action of drive sleeve 112 and its flange 120 when the gate bar 103 is raised to its upright position will insure that the lug 130 engages the microswitch plunger 132 to open the microswitch when the stop arm 134 engages the stop member 135 at the end of the elevating movement of gate bar 103.

Mounted on the supporting plate 113 is a 3-phase alternating current motor M which is coupled by a belt 136 to the input pulley 137 of a conventional speed-reducing unit 138 having an output shaft 139. Secured to shaft 139 is a crank arm 140 which is drivingly connected by a link bar 141 to an arm 142 rigidly secured to the drive sleeve 112. Rotation of the crank arm 140 oscillates the arm 142 from the normal position thereof shown in FIG. 4 rightwards to a position wherein the gate bar 103 is elevated to its upright position and then leftwards back to the position shown in FIG. 4. Thus, rotation of the arm 140 in a clockwise direction, as viewed in FIG. 4, through 180° rotates the driven arm 142 clockwise through an angle of 90°. Further rotation clockwise of the crank arm 140 back to the position thereof shown in FIG. 4 returns the arm 142 to the position shown in FIG. 4 and restores the gate bar 103 to its horizontal position.

Figure 9:
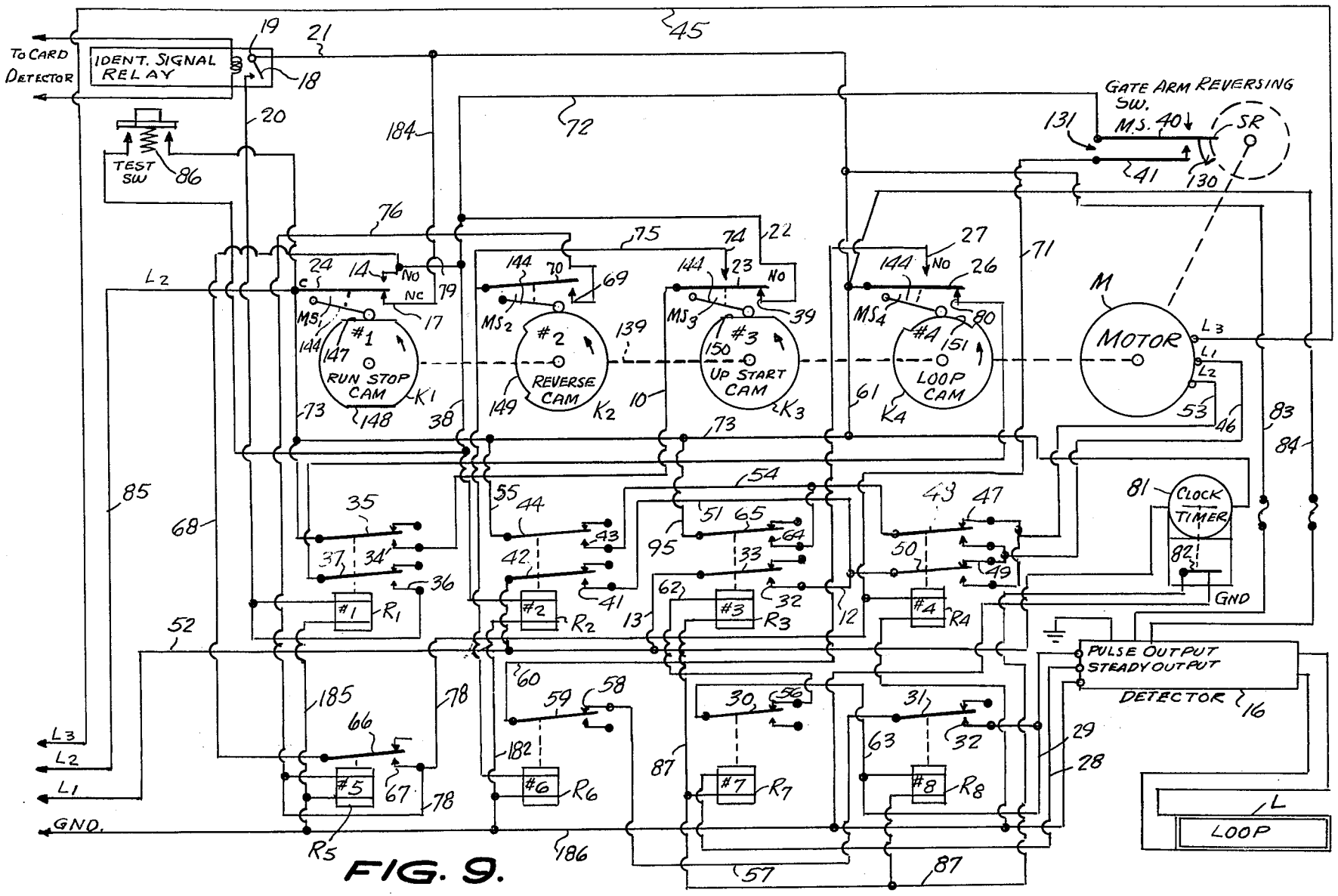
FIG. 9 is a wiring diagram showing the electrical connections of the elements forming the control circuit of the typical parking lot gate-controlling system of FIGS. 1 to 7.

Secured on the shaft 139 are respective control cams $K_1$, $K_2$, $K_3$ and $K_4$ which are shaped in the manner diagrammatically illustrated in FIG. 9 to control the operation of respective microswitches $MS_1$, $MS_2$, $MS_3$ and $MS_4$ secured to a supporting bracket 143 which is in turn fastened to the frame of the reducing gear unit 138, the microswitches being arranged in overlying relationship to their associated cams so that their operating levers 144 engage the peripheries of the cams. Also supported by the bracket 143 is a test switch 86 whose function will be presently explained.

As shown in FIG. 9, the cam $K_1$ has diametrically opposite flats 147, 148 and the associated microswitch $MS_1$ is of the single pole, double-throw type having a pole 24 normally engaging a lower contact 17 and being movable into engagement with an upper contact 14 as the cam rotates away from its position shown in FIG. 9 and its operating arm 144 engages the arcuate periphery of the cam.

The cam $K_2$ has a notched out portion 149 having an angular extent of approximately 90° and located so that the operating arm of the associated microswitch $MS_2$ falls into the notch 149 during the reverse portion of the cycle, namely, when the gate bar 103 is being lifted (the cam rotating in a counterclockwise direction, as viewed in FIG. 9). The associated microswitch $MS_2$ is of the single pole, single throw type and has a pole 70 and a stationary contact 69 which is engaged by the pole 70 when the operating arm of the microswitch falls into the notch 149.

The cam $K_3$ has a flat 150 normally engaged by the operating arm of the microswitch, whereby the operating arm is elevated when the cam rotates away from its normal position shown in FIG. 9. The associated microswitch $MS_3$ is of the single pole, double-throw type and has a pole 23 normally engaging a stationary contact 39 but disengaging therefrom and being movable into engagement with an opposite stationary contact 74 responsive to the rotation of the cam $K_3$ sufficiently to cause its operating arm to engage the circular periphery of the cam.

The cam $K_4$ has an arcuate notched out portion 151 having an angular extent of approximately 90° normally engaged by the operating arm of the cam, namely, in the position shown in FIG. 9, the associated microswitch $MS_4$, being of the single pole, double-throw type and having a pole 26 normally engaging a stationary contact 80 but being movable away from said stationary contact into engagement with an opposite stationary contact 27 when the operating arm engages the normal outer circular periphery of the cam.

As shown in FIG. 3, the loop detector unit 16 is likewise mounted on the base plate 113, and respective relays $R_1$ to $R_8$ are also mounted on said base plate.

The loop detector 16, which is a conventional device, as above mentioned, is provided with an adjustment panel 152, shown in FIG. 8, carrying the various controls for suitably adjusting the unit, namely, for properly tuning same, for adjusting its sensitivity, and the like. The loop detector unit 16 is supported on an upstanding bracket 153 rigidly secured to base plate 113 in any suitable manner.

The apparatus is further provided with a clock timer 81 of conventional construction which can be set to provide operation of the system only during a predetermined time period, as will be further described.

FIG. 9 shows the electric circuit details of the system, and to facilitate description thereof, a typical operational cycle of the system will be now described.

From FIG. 9, it will be seen that the 3-phase motor M has one terminal thereof connected by a wire 45 to power supply wire $L_3$ at all times. The motor has its other two phase terminals connected to wires 53 and 46, which must be in turn connected to the remaining power supply line wires $L_2$ and $L_1$ in order to energize the motor. For forward operation of motor M, it will be seen that this requires the energization of a relay $R_2$, as will be presently described.

Assuming that the driver of an incoming vehicle wishes to enter the parking lot, and therefore requires elevation of the barrier gate arm 103, the driver inserts a suitable identification card, or in the case of coin operation, a suitable coin, into the device 100, which thereby operates to energize the "identification signal relay" 19 and cause it to close its contacts 18, which thereby connect a wire 20 to a wire 21. This energizes a relay $R_1$ through a circuit from ground wire 186, a wire 185, the winding of the relay $R_1$, wire 20, contacts 18, wire 21, a wire 184, microswitch contact 17, switch pole 24 and the wire 85 leading to line supply wire $L_2$. This closes relay contacts 34, 35 and 36, 37. Relay $R_2$ is energized by a circuit from ground wire 186, a wire 182, the winding of relay $R_2$, a wire 38, a wire 22, microswitch contacts 39, 23 associated with cam $K_3$, a wire 10, contacts 34, 35 of relay $R_1$, a wire 73, and the wire 85 connected to phase supply wire $L_2$. This connects motor phase wire 46 to supply wire $L_1$ through a circuit comprising contacts 49, 50 of relay $R_4$, a wire 51, contacts 41, 42 of relay $R_2$, and a wire 52. The other phase wire 53 of motor M is connected to the remaining power supply wire $L_2$ through a circuit comprising contacts 47, 48 of relay $R_4$, a wire 54, contacts 43, 44 of relay $R_2$, a wire 55, a wire 73 and wire 85. The motor is thereby energized in a forward direction and begins to elevate gate arm 103, causing the cams shown in FIG. 9 to rotate in a counterclockwise direction.

The "upstart" cam $K_3$ opens its contacts 23, 39 but at the same time, the contacts 24, 14 of the "run stop" cam $K_1$ close, holding the relay $R_2$ energized through the circuit comprising wire 38, wire 79, contacts 14, 24, and the supply wire 85. After 180° of counterclockwise rotation, as viewed in FIG. 9, the contacts 24, 14 open, deenergizing the relay $R_2$, whereby the motor M becomes deenergized. At this time, the contacts 26, 27 of the "loop" cam $K_4$ are closed.

With the arm 103 in its upright position, the car then drives over the loop L. This causes the detector unit 16 to generate a continuous signal in its output wire 28 and a pulse in its output wire 29. The continuous signal on wire 28 energizes the relay $R_7$ through a circuit comprising the wire 28, the winding of relay $R_7$ and the grounded wire 87. When the relay $R_7$ becomes energized, it opens its contacts 30, 56.

The relay $R_8$ is energized by the pulse in the wire 29 through a circuit comprising wire 29, the winding of the relay $R_8$, and the grounded wire 87. Relay $R_8$ thus closes its contacts 31, 32. The relay $R_8$ thus becomes latched by a circuit comprising the grounded wire 87, the winding of the relay $R_8$, the wire 29, the contacts 31, 32, a wire 57, the normally closed contacts 58, 59 of relay $R_6$, a wire 60, the contact 27, 26 of cam $K_4$, the wire 61, the wire 73, and the supply line wire 85. The relay $R_8$ is in control of the relay $R_3$ through the latching circuit of the relay $R_8$, as will be presently explained.

When the car leaves the loop L, the steady signal in the wire 28 is terminated and the relay $R_7$ becomes deenergized, closing the contacts 30, 56. The relay $R_3$ becomes energized by a circuit comprising the grounded wire 87, the winding of the relay $R_3$, a wire 62, the contacts 56, 30, a wire 63, the wire 29, the contacts 31, 32 of relay $R_8$, wire 57, the contacts 58, 59 of the relay $R_6$, the wire 60, the contacts 27, 26 of the cam $K_4$, the wire 61, the wire 73 and the line supply wire 85. The motor M is thus energized by a circuit comprising the $L_1$ line wire 52, a wire 13, the lower contacts 33, 32 of the relay $R_3$, a wire 12, the contacts 50, 49 of the relay $R_4$ and the wire 46, and by a circuit comprising the $L_2$ line wire 85, the wire 73, a wire 95, the upper contacts 65, 64 of relay $R_3$, the wire 54, the contacts 48, 47 of the relay $R_4$, and the wire 53. The energization of the motor M causes the gate bar 103 to begin its descent, reenergizing relay $R_2$. The gate bar moves downwardly and approaches its lowered normal position and the cam $K_4$ opens its contacts 26, 27 to thereby deenergize the relay $R_8$, and release relay $R_3$, but the "run stop" cam $K_1$ holds the contacts 24, 14 closed (holds the relay $R_2$ energized) until the gate arm 103 is substantially in its horizontal lowered position. When the contacts 24, 14 open, the relay $R_2$ releases, opening the contacts 44, 43 and 42, 41, thus deenergizing the motor M. This restores the normal condition of the system.

It will be noted that on the return portion of the gate bar 103, the "reverse" cam $K_2$ closes its contacts 70, 69 allowing the reversing relay $R_4$ to be energized if necessary, by a circuit from wire 85, contacts 24, 14, wire 68, the contacts 66, 67 of relay $R_5$, the winding of the relay $R_4$, and the ground wire 186. Thus, the motor $M_1$ will be reversed if the relay $R_5$ is energized. Alternatively, another reversing circuit is provided comprising the grounded wire 186, the winding of the relay $R_4$, the wire 71, the contacts 41, 40 of microswitch 131, the wire 72, the wire 79, the contacts 24, 14 and the supply line wire 85.

The operation of the first-mentioned reversing circuit takes place when, during the return movement of the gate bar 103, the identification signal relay 19 is energized, as by the insertion of a succeeding identification card or coin in the device 100 by the driver of a closely following vehicle. Thus, the operation of the relay 19 energizes the relay $R_5$ by a circuit comprising supply line wire 85, wire 73, contacts 35, 34 of relay $R_1$ (energized by the closure of the contacts 18, as above described) a wire 10, the contacts 23, 74 of cam $K_3$, wire 75, contacts 70, 69 of the "reverse" cam $K_2$, wire 76, the winding of relay $R_5$, and the ground wire 186. Thus, the identification action of a second closely following car can reverse the downward movement of the gate bar 103 and cause it to be returned to its upright position. The relay $R_5$ is locked in parallel with the relay $R_4$ by the wire 78. The relay $R_4$ thus becomes energized simultaneously with the relay $R_5$.

The relay $R_5$ similarly becomes energized responsive to the closure of the contacts 40, 41 of microswitch 131, which takes place when the descending gate bar 103 encounters an obstacle, as above explained. The closure of the contacts 40, 41 energizes the relay $R_5$ through a circuit comprising supply line wire 85, wire 73, contacts 24, 14 of cam $K_1$, wire 79, wire 72, the contacts 41, 41, wire 71, wire 78, the winding of relay $R_5$, and ground wire 186. The reversing relay $R_4$ is also energized because its winding is connected in parallel with the winding of relay $R_5$. Thus, if the arm 103 encounters a car while it is descending, the motor M is reversed.

It will be noted that the relay $R_6$ is energized when relay $R_1$ becomes energized and cam $K_3$ begins to rotate, by a circuit comprising supply line wire 85, wire 73, the contacts 35, 34 of relay $R_1$, wire 10, contacts 23, 74 of cam $K_3$, wire 75, the winding of relay $R_6$ and ground wire 186. This opens the contacts 58, 59 and prevents relay $R_8$ from being latched at this time, but allows the relay $R_8$ to be later operated by a pulse in the wire 29. (The purpose of the relay $R_8$ is to latch the relay $R_3$; by preventing relay $R_3$ from being latched, the motor M has to be energized through the contacts of the relay $R_2$ at the beginning of the cycle).

As long as a car is on the loop L, the relay $R_7$ is energized and the contacts 30, 56 are open; relay $R_3$ cannot then be energized. With the gate bar 103 partly up, a second car entering cannot energize relay $R_1$ through the contacts 24, 17 of cam $K_1$, but can only momentarily energize it directly; however, relay $R_1$ will not latch because contacts 26, 80 of cam $K_4$ are open; (relay $R_1$ is latched only a short time near the beginning of the upward movement of the gate; relay $R_2$ is maintained by contacts 24, 14 of cam $K_1$ when contacts 80, 26 of cam $K_4$ open. Motor M operates until contacts 24, 14 of cam $K_1$ open, namely, when the gate is upright, and at this time relay $R_2$ drops out). Thus, it will be seen that a closely following second car will pass onto the loop L and the gate bar 103 will stay up until the last car leaves the loop, causing the relay $R_3$ to be energized and complete the cycle.

The clock timer 81 has a timed switch 82 in the ground circuit for the relay windings of relay $R_3$, $R_7$ and $R_8$, allowing operation of the above-described system only during the periods when the switch 82 is closed.

As shown in FIG. 9, two separately fused power supply conductors 83 and 84 supply line voltage from the wire 61 to respective internal circuits in the detector unit 16 for generating the steady output for the output wire 28 and the pulse output for the output wire 29.

The test switch 86 is connected so that it can be employed at times to shunt the wires 73, 38 to thereby enable relay $R_2$ to be energized and to thus start a cycle and elevate the gate bar 103, and to also cause it to be returned by the system to its normal position.

As above mentioned, the purpose of the relay $R_3$ is to insure that the gate bar 103 returns when a car leaves the loop L. Thus, when a car leaves the loop, the steady signal of wire 28 terminates and relay $R_7$ becomes deenergized, closing its contacts 30, 56. This energizes the relay $R_3$ through the latching circuit including the contacts 31, 32 of the relay $R_8$, as above explained. This also connects the upper contacts 65, 64 of relay $R_3$ across the wires 73, 54, so that the motor M can be energized as long as relay $R_3$ is energized. However, since the energization of relay $R_3$ depends upon the deenergization of the relay $R_7$, relay $R_3$ can never be energized when a car is on the loop L, since this maintains the steady signal in the wire 28 which holds relay $R_7$ energized and holds its contacts 30, 56 open.

It will be further noted that the identification signal-responsive relay $R_1$ has a latching circuit including its contacts 37, 36 which holds relay $R_1$ energized as long as the contacts 26, 80 of "loop" cam $K_4$ are closed, namely, while the operating arm of the microswitch $MS_4$ is engaging the notch 151 in the periphery of cam $K_4$. This insures the energization of the relay $R_2$ during the starting portion of the operational cycle of the system.

While a specific embodiment of an improved parking lot gate control system has been disclosed in the foregoing description, it will be understood that various modifications within the spirit of the invention may occur to those skilled in the art. Therefore, it is intended that no limitations be placed on the invention except as defined by the scope of the appended claims.

What is claimed is:

1. For use in connection with a parking lot, a gate bar at the entrance to the lot, normally in an obstructing position, a clearance device ahead of said entrance adapted to receive an authorization means, means to move said gate bar to a non-obstructing position responsive to the reception of such authorization means by said clearance device, vehicle-sensing means in the roadway adjacent said gate bar, means to hold said gate bar in its non-obstructing position while a vehicle is over said sensing means, means to return said gate bar to said obstructing position responsive to the movement of the vehicle away from said sensing means wherein the moving and return means for the gate bar comprises:

1. electrically operated drive means provided with a first drive means energizing circuit including the contacts of normally deenergized first relay means,

2. normally open first cam switch means coupled to the gate bar and closing in response to the initial operation of the drive means,

3. second relay means controlled by said clearance device, 4. normally closed second cam switch means coupled to the gate bar, 5. a first circuit connected to said first relay means for momentarily energizing same and including the contacts of said second relay means and said normally closed second cam switch means, and 6. a second circuit connected to said first relay means for energizing same and including said first cam switch means.

2. The structural combination of claim 1, and wherein said first cam switch means is formed to open said second circuit when the gate bar reaches its non-obstructing position.

3. The structural combination of claim 2, and wherein said first cam switch means is formed to again close said second circuit during subsequent return movement of said gate bar.

4. The structural combination of claim 3, and second drive means energizing circuit connected to said drive means including additional relay means operating responsive to a vehicle moving away from the sensing means to initiate the return movement of said gate bar.

5. The structural combination of claim 4, and wherein the second drive means energizing circuit includes reversing relay means, and means to operate said reversing relay means responsive to the energization of said second relay means by the clearance device during the return movement of said gate bar.

6. The structural combination of claim 5, and slip clutch means coupling the drive means to the gate bar, slip-responsive switch means operated by said slip clutch means, and means to operate said reversing relay means responsive to the operation of said slip-responsive switch means when the gate bar encounters an obstacle in its return, whereby to reverse the movement of the gate bar.

7. The structural combination of claim 6, and cooperating stop means on the gate bar and the drive means being arranged to return said switch means to its original condition and deenergizing said reversing relay means when the gate bar is returned to its non-obstructing position.

8. A parking lot gate mechanism comprising:

a. a gate bar at the entrance of the lot, b. a clearance device ahead of said entrance adapted to receive authorization means, c. vehicle sensing means adjacent said gate bar, d. gate control means for moving said gate from an obstructing position to a non-obstructing position in response to reception of authorization means by said clearance device, e. said gate control means operable in response to said sensing means, upon movement of said vehicle away from said sensing means, for moving said gate bar back to an obstructing position, f. said gate control means comprising:

1. motor means connected for moving said gate bar, 2. a first relay, 3. means for operating said first relay in response to said clearance device, 4. a first electrical path for energizing said motor means in response to operation of said first relay, 5. a second relay, 6. means for operating said second relay in response to movement of said vehicle away from said vehicle sensing means, 7. a second electrical path for energizing said motor means in response to operation of said second relay, 8. a third relay having contacts in said first and second electrical paths, said third relay contacts operable to reverse the direction of said motor means, thereby reversing the direction of movement of said gate bar, 9. means for operating said third relay in response to an obstruction while the gate bar is moving to an obstructing position, and 10. means for operating said third relay in response to reception of another authorization means by said clearance device.

9. A parking lot gate mechanism as recited in claim 8 wherein said means to operate said first relay comprises:

a. a start relay and a first cam switch for momentarily operating said first relay, b. a second cam switch for subsequently operating said first relay, and c. said first and second cam switches operably connected to said motor means.

10. A parking lot gate mechanism as recited in claim 8 wherein said means for operating said second relay comprises a third cam switch operably connected to said motor means.

11. A parking lot gate mechanism as recited in claim 10 wherein said means for operating said second relay further comprises an additional relay energized in a circuit path comprising said third cam switch.

12. A parking lot gate mechanism as recited in claim 8 wherein said means for operating said third relay in response to an obstruction comprises a microswitch attached to said gate and actuated by contact with said obstruction.

13. A parking lot gate mechanism as recited in claim 12 wherein said means for operating said third relay in response to an obstruction further comprises a reverse relay having contacts in circuit with said microswitch.

14. A parking lot gate mechanism as recited in claim 13 wherein said means for operating said third relay in response to an obstruction further comprises said second cam switch in circuit with said reverse relay and said microswitch.

15. A parking lot gate mechanism as recited in claim 14 wherein said means for operating said third relay in response to another authorization means comprises said reversing relay.

16. A parking lot gate mechanism as recited in claim 15 wherein said means for operating said third relay in response to another authorization means further comprises said first cam switch and a reverse cam switch operably connected to said motor means.

17. A parking lot gate mechanism as recited in claim 9 wherein said means for operating said third relay in response to another authorization means comprises a reversing relay, said first cam switch and a reverse cam switch operably connected to said motor means, said reversing relay having contacts in circuit with said first cam switch and said reverse cam switch.

* * * * *